US010398620B2

(12) United States Patent
Unbescheiden et al.

(10) Patent No.: US 10,398,620 B2
(45) Date of Patent: Sep. 3, 2019

(54) WATER JET MASSAGING APPARATUS WITH PATIENT SUPPORT SHEET AND SUPPORT ELEMENT

(71) Applicant: UNBESCHEIDEN GMBH, Baden-Baden (DE)

(72) Inventors: Heinrich Unbescheiden, Rastatt (DE); Mark Unbescheiden, Buehlertal (DE)

(73) Assignee: UNBESCHEIDEN GMBH, Baden-Baden (DE)

( * ) Notice: Subject to any disclaimer, the term of this patent is extended or adjusted under 35 U.S.C. 154(b) by 408 days.

(21) Appl. No.: 15/357,911

(22) Filed: Nov. 21, 2016

(65) Prior Publication Data

US 2018/0140508 A1 May 24, 2018

(51) Int. Cl.
*A61H 9/00* (2006.01)

(52) U.S. Cl.
CPC ... *A61H 9/0021* (2013.01); *A61H 2201/1654* (2013.01); *A61H 2201/1669* (2013.01)

(58) Field of Classification Search
CPC ..... A61H 9/00; A61H 9/0007; A61H 9/0021; A61H 9/0028; A61H 9/0071; A61H 2009/0035; A61H 2009/0042
See application file for complete search history.

(56) References Cited

U.S. PATENT DOCUMENTS 4,853,988 A * 8/1989 Mutzell ..... A61H 23/04 4/615
4,976,256 A * 12/1990 Marlin ..... A61H 9/0021 5/670
5,540,651 A * 7/1996 Risch ..... A61H 9/0021 160/392
5,842,241 A * 12/1998 Cooper ..... A47C 27/085 5/670
6,139,512 A * 10/2000 Ricchio ..... A61H 23/04 4/541.4
6,210,351 B1 * 4/2001 Korenaga ..... A61H 9/0021 5/670
7,311,683 B2 * 12/2007 Turell ..... A61H 9/0071 601/157
7,998,098 B2 * 8/2011 Yang ..... A61H 39/04 601/134
8,348,871 B2 * 1/2013 Elliott ..... A61H 9/00 601/148
2004/0193077 A1 * 9/2004 Hsu ..... A61H 9/0071 601/49
2016/0206506 A1 * 7/2016 Henkemans ..... A61H 33/0087

* cited by examiner

*Primary Examiner* — LaToya M Louis
(74) *Attorney, Agent, or Firm* — Klaus J. Bach

(57) ABSTRACT

In a water jet massaging apparatus having a tub which is covered by a flexible elastic support sheet or foil for supporting a patient and a nozzle carriage with a nozzle and carriage drive arrangement disposed in the tub below the support sheet or foil for directing a water jet onto the support sheet, a rigid or at least non-elastic support element is disposed between the flexible elastic support sheet or foil and the nozzle carriage at a distance from the flexible elastic support sheet or foil so as to prevent the flexible elastic support sheet to come into contact with the nozzle carriage and the carriage drive arrangement.

9 Claims, 1 Drawing Sheet

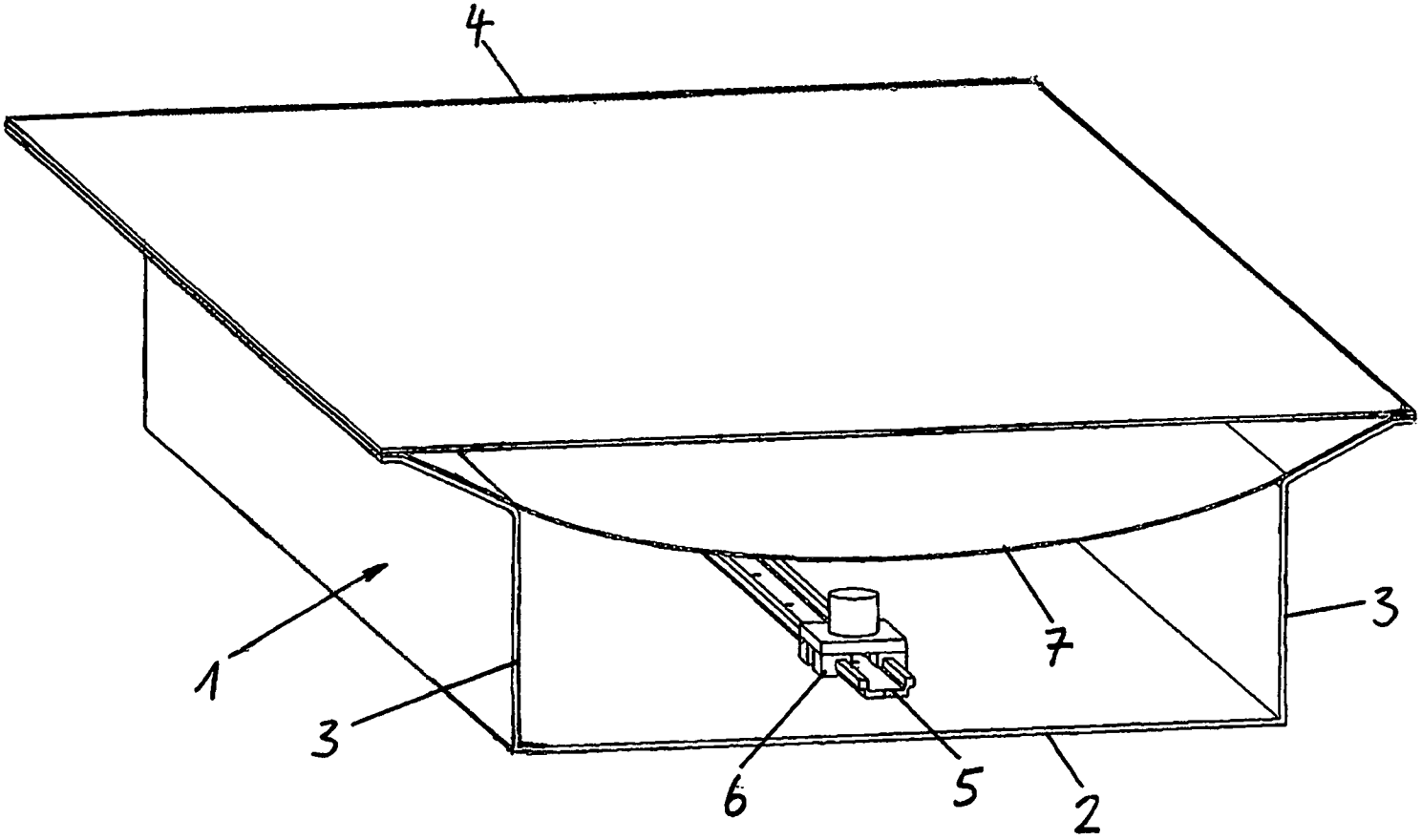
4
3
1
7
3
5
6
2

WATER JET MASSAGING APPARATUS WITH PATIENT SUPPORT SHEET AND SUPPORT ELEMENT

BACKGROUND OF THE INVENTION

The invention resides in a water jet massaging apparatus with a patient support sheet supporting element.

Water jet massaging apparatus include a tub which is covered at its top by a flexible support sheet or foil forming a resting surface for a patient. In the interior of the tub, there is at least one nozzle mechanism with a nozzle to which pressurized water is supplied by a pump for directing a massaging water jet toward the bottom side of the patient support sheet for dry water jet massaging of a patient laying on the patient support surface.

The patient support sheet needs to be a relatively thin flexible and also elastic foil via which the effects of the water jet can be transferred to the body of the patient laying on the support surface effectively in a mostly undamped manner. Flexibility and elasticity of the foil forming the patient support surface is very important to permit adaptation of the foil to the body shape of the patient in such a way that no spaces are formed between the support sheet or foil and the body surface of the patient which would detrimentally affect the massaging effect of the massaging water jet on the body of the patient.

This required flexibility and elasticity of the patient support foil however has the disadvantage that, with localized loading, particularly in the center area of the tub, the support foil is pressed quite deeply into the interior of the tub. This occurs for example when a patient, in the process of laying down onto the support foil, first sits onto the foil or when the patient first sits up when getting off the support foil. At those occasions, the patient is sitting about in the center area of the support foil whereby the center of the support foil is pressed down locally quite deeply into the tub.

As a result, the nozzle mechanism disposed in the tub below the support foil may easily be damaged.

In the commonly used water jet massaging apparatus, the nozzle mechanism comprises a nozzle carrier arrangement including at least one nozzle carriage which is provided with at least one nozzle and generally is supported in the tub so as to be movable in the longitudinal direction of the tub. The nozzle again is often movably supported on the carriage so as to permit sideward movement or sideward pivoting of the nozzle so that the water jet cannot only be moved along the center of the tub but also in the transverse direction. It is possible that a patient sits up while the treatment is not yet completed that is while the nozzle carriage is still moving which may cause damage to nozzle arrangement in particular the nozzle operating mechanism when located in the area below the patient sitting on the support foil. In this case, the movement of the nozzle carriage may be blocked by the load of the patient which may result in damage to the carriage drive mechanism. Also, the nozzle support structure on the nozzle carriage as well as the carriage itself may be damaged resulting in expensive repairs and out-of-service times for the apparatus.

It is the principal object of the present invention to provide a massaging apparatus design wherein the chances of damaging the water jet massaging arrangement by a patient are essentially eliminated.

SUMMARY OF THE INVENTION

In a water jet massaging apparatus comprising a tub which is covered by a flexible elastic support sheet or foil for supporting a patient, with a nozzle carriage and carriage drive arrangement disposed below the support sheet or foil, and a water pump connected to a nozzle of the nozzle carriage for directing a water jet onto the support sheet, a rigid or at least non-elastic support element is disposed between the flexible elastic support sheet and the nozzle carriage and drive arrangement to support any local load and prevent the elastic support sheet to come into contact with the nozzle carriage and drive arrangement. The support element is so configured that it does not allow destruction of the massaging wafer jet nozzle or carriage.

To this end, the support element is preferably grid-like or net-like. It may also be flexible but not elastic. It must not permit a local downward deformation into the tub by a localized load, that is, its downward movement is safely limited and damage to a nozzle carrying carriage moving in the tub below the support element, is therefore prevented.

The support element may be a rigid grid structure; however it may also be in the form of a textile fabric without the need of a grit-like structure. Such a fabric is not permeable for the massaging water jet and accordingly most be so supported and dimensioned that, during operation of the apparatus, the fabric sheet is pressed by the water jet against the bottom side of the patient support sheet or foil and abuts the support sheet such that the massaging effect of the water jet is transmitted to the patient through the fabric and the support sheet or foil.

The invention is also important in connection with water jet massaging apparatus which—different from the nozzle mechanisms in the form of nozzle carriage arrangements with at least one movable nozzle carriage—have a nozzle mechanism with nozzles which are stationary within the tub, and which, in order to move the water jet, require pivoting and a corresponding mechanism for pivoting the nozzles since also the pivoting mechanism is quite sensitive.

The invention will become more readily apparent from the following description of a particular embodiment thereof with reference to the accompanying drawings.

BRIEF DESCRIPTION OF THE DRAWINGS

The sole FIGURE shows schematically in a cross-sectional view a water jet massaging apparatus with a patient support sheet and a support element according to the invention.

DESCRIPTION OF AN EXEMPLARY EMBODIMENT

As shown in the FIGURE, a water jet massaging apparatus includes a tub 1 with a tub bottom 2 and sidewalls 3 which, at the top, are bent outwardly.

The tub is covered by an elastic support sheet or foil 4 which is stretched over the tub. In the area of the tub bottom 2, a nozzle carriage arrangement with a guide track 5 and a nozzle carriage 6 is shown.

As is further shown, below the support sheet or foil 4, there is a support element 7 which—like the support sheet or foil 4—is connected to the tub 2 at the side walls thereof.

The support element 7 may be in the form of a rigid or a flexible, but not elastic, lattice or a non-elastic net of textile or other suitable material whose lattice wires or net fibers are as thin as possible and whose lattice or net apertures are as large as possible so as to affect the massaging water jet as little as possible but nevertheless ensure the strength needed to safely accommodate or hold the weight of a patient sitting on the support sheet or foil 4 and pushing it downwardly onto the support element 7.

As shown in the FIGURE, the support element 7 is so arranged that it extends below the patient support sheet or foil 4 in spaced relationship therefrom so that, with a patient laying on the patient support sheet or foil and the resulting lowering of the patient support sheet, the patient support sheet remains sufficiently spaced from the support element 7 that the patient support sheet 4 does not come into contact with the support element 7 even when the patient moves on the support sheet 4. At the same time, the support element 7 is arranged at a height over the nozzle carriage arrangement sufficient not to hinder the movement of the nozzle carriage disposed on the tub bottom below the support element 7, And when a patient is for example sitting on the patient support sheet and locally further depresses parts of the patient support sheet 4 the patient support sheet is supported by the support element 7 thereby to prevent contact with the carriage arrangement As mentioned earlier, the support element 7 may also be in the form for example of a textile fabric wherein however the arrangement and support has to comply with the criteria mentioned above that to prevent damage to the nozzle carriage and carriage operating arrangement.

What is claimed is:

1. A water jet massaging apparatus comprising:

a tub (1) having a bottom (2) and side walls (3), a flexible elastic support sheet or foil (4) stretched across the side walls (3) so as to cover the tub (1), a nozzle mechanism arranged in the interior of the tub and including at least one nozzle to which pressurized water can be supplied for directing a water jet onto the support sheet or foil (4) for massaging a person laying on the support sheet or foil (4), and a support element (7), which is arranged within the tub (1) below the flexible elastic support sheet or foil (4) at such a distance therefrom that the flexible elastic support sheet or foil (4) does not come into contact with the support element (7) when a patient is laying on the flexible elastic support sheet or foil (4) the support element is spaced from the support sheet or foil by a hollow air space spanning the distance and the support element is above the nozzle mechanism (6) and is non-elastic so as to limit downward displacement of the support sheet or foil (4) when an excessive load is applied thereto in order to prevent the flexible elastic support sheet or foil (4) from contacting the nozzle mechanism arranged in the tub (1) below the support element (7).

2. The water jet massaging apparatus according to claim 1, wherein the non-elastic support element (7) is one of a lattice structure and a textile fabric.

3. The water jet massaging apparatus according to claim 1, wherein the support element (7) comprises a rigid lattice structure.

4. The water jet massaging apparatus according to claim 1, wherein the support element (7) is in the form of flexible but non-elastic lattice structure.

5. The water jet massaging apparatus according to claim 1, wherein the support element (7) is in the form of a non-elastic net structure.

6. The water jet massaging apparatus according to claim 5, wherein the net structure consists of high-stress resistant thin lattice wires or net fibers with large mesh width.

7. The water jet massaging apparatus according to claim 1, wherein the nozzle mechanism comprises a nozzle carriage (6), which is provided with at least one nozzle and supported so as to be movable in the longitudinal and the transverse directions of the tub (1).

8. The water jet massaging apparatus according to claim 1, wherein the nozzle mechanism comprises at least one nozzle arranged in the tub (1) in a stationary position.

9. The water jet massaging apparatus according to claim 8, wherein the stationary nozzle is angularly movable for changing the angle of a water jet emitted from the nozzle.

* * * * *